US009366221B2

(12) United States Patent
Stifel et al.

(10) Patent No.: US 9,366,221 B2
(45) Date of Patent: Jun. 14, 2016

(54) CORONA IGNITION DEVICE

(71) Applicant: BorgWarner BERU Systems GmbH, Ludwigsburg (DE)

(72) Inventors: Timo Stifel, Stuttgart (DE); Andreas Ehrhardt, Plochingen (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 133 days.

(21) Appl. No.: 14/167,641

(22) Filed: Jan. 29, 2014

(65) Prior Publication Data

US 2014/0216382 A1 Aug. 7, 2014

(30) Foreign Application Priority Data

Feb. 1, 2013 (DE) ..... 10 2013 101 060

(51) Int. Cl.

| | |
|---|---|
| ***F02P 23/04*** | (2006.01) |
| ***H01T 13/44*** | (2006.01) |
| ***F02P 7/02*** | (2006.01) |
| ***F02P 3/02*** | (2006.01) |
| ***H01T 13/54*** | (2006.01) |

(52) U.S. Cl.

CPC . *F02P 23/04* (2013.01); *F02P 3/02* (2013.01); *F02P 7/026* (2013.01); *H01T 13/44* (2013.01); *H01T 13/54* (2013.01)

(58) Field of Classification Search

CPC ..... F02P 23/04; F02P 7/026; F02P 3/02; H01T 13/44; H01T 13/54

See application file for complete search history.

(56) References Cited

U.S. PATENT DOCUMENTS

| | | | | |
|---|---|---|---|---|
| 5,419,300 | A * | 5/1995 | Maruyama et al. | 123/634 |
| 6,883,507 | B2 * | 4/2005 | Freen | 123/606 |
| 2009/0289752 | A1 | 11/2009 | Akimoto | |
| 2010/0175655 | A1 * | 7/2010 | Lykowski et al. | 123/169 R |
| 2011/0010927 | A1 | 1/2011 | Akimoto | |

FOREIGN PATENT DOCUMENTS

| | | | |
|---|---|---|---|
| DE | 10 2009 002 407 | A1 | 12/2009 |
| DE | 10 2010 055 570 | B3 | 3/2012 |
| EP | 1 515 594 | A2 | 3/2005 |

* cited by examiner

*Primary Examiner* — Lindsay Low
*Assistant Examiner* — Jacob Amick
(74) *Attorney, Agent, or Firm* — Bose McKinney & Evans LLP

(57) ABSTRACT

The invention relates to a corona ignition device for igniting fuel in a combustion chamber of an engine by means of a corona discharge, said corona ignition device comprising an insulator, a center electrode, which is held in the insulator, a housing, in which the insulator is held, and coil turns, which are disposed in a cylindrical main part of the housing and are connected to the center electrode. According to an aspect of this disclosure, the housing widens on the side of the main part remote from the insulator and further coil turns are disposed there, in a wider housing part.

10 Claims, 2 Drawing Sheets

CORONA IGNITION DEVICE

RELATED APPLICATIONS

This Application claims priority to DE 10 2013 101 060.1, filed Feb. 1, 2013, the entire disclosure of which is hereby incorporated herein by reference in its entirety.

BACKGROUND

The invention is directed to a corona ignition device for igniting fuel in a combustion chamber of an engine by a corona discharge, as is generally known from DE 10 2010 055 570 B3.

Corona ignition devices comprise a center electrode, which is held in an insulator and is thereby electrically insulated against a housing and the walls of the combustion chamber, which are at ground potential. The center electrode and a coil connected thereto form a capacitance together with the surrounding housing. This capacitance and the coil form an electric oscillating circuit, which is excited with a high frequency voltage, which is generated, for example, with the aid of a transformer having a center tap or another high frequency generator, and which typically has a frequency between 30 kHz and 3 MHz. When the oscillating circuit undergoes resonant excitation, a voltage spike occurs between the center electrode and the walls of the combustion chamber or the housing of the corona ignition device. This causes a corona discharge to form in the combustion chamber, said corona discharge originating from an ignition tip on the center electrode. This generates so many ions and radicals in the combustion chamber that the fuel-air mixture ignites.

SUMMARY

This disclosure provides a way in which the efficiency of a corona ignition device can be increased.

In a corona ignition device according to this disclosure, some of the coil turns are located in a cylindrical main part of the housing and some of the coil turns are located in a wider housing part, which adjoins the end of the main part remote from the insulator. The corona ignition device can comprise two coils, which are connected to one another in series, or only one coil, the coil form of which extends out of the cylindrical main part into the wider housing part. The term "wider" relates to the radial extension. The wider housing part is therefore thicker than the cylindrical main part, which has the greatest portion of the overall length of the housing.

Joining a further housing part having further coil turns to the cylindrical main part makes it possible to use thicker wire for the coil turns. This makes it possible to significantly reduce ohmic power losses, since thicker wire has a lower electric resistance than thinner wire.

The number of coil turns in the wider housing part can vary within wide limits. It is favorable for between one-fourth and two-thirds of the total number of coil turns to be disposed in the wider housing part. Preferably, between one-third and one-half of the total number of coil turns is located in the wider housing part, that is, the sum of the number of coil turns in the housing main part and the number of coil turns in the wider housing part.

According to an advantageous refinement of this disclosure, the further coil turns have a greater diameter than the coil turns in the main part. Coil turns having a greater turn diameter make a correspondingly greater contribution to the overall inductance of the corona ignition device, and therefore a correspondingly smaller number of coil turns is sufficient.

The housing can widen abruptly from the cylindrical main part outward. In this case, the wider housing part can be cylindrical and can directly adjoin the cylindrical main part. It is also possible, for example, for the housing to widen conically from the cylindrical main part outward. When the wider housing part is conical, the coil turns disposed therein can be wound onto a conical coil form or coil form section. It is thereby advantageously possible to achieve a constant ratio between the coil diameter and the housing diameter.

According to a further advantageous refinement of this disclosure, most of the coil turns in the main part of the housing have an outer diameter that is between 0.55 and 0.57 times the inner diameter of the main part of the housing. Although coil turns having such dimensions are optimal per se for the electric properties of the corona ignition device, it is not necessarily advantageous to design all coil windings in the main section this way. That is to say, field peaks can occur at the connection to the center electrode, thereby increasing the risk of voltage overloads. This can be prevented by providing the coil with an end section that tapers toward the insulator.

According to a further advantageous refinement of this disclosure, in the wider housing part, the ratio between the outer diameter of the turns and the inner diameter of the wider housing part is between 0.55 and 0.57. When the wider housing part is cylindrical, the coil turns can be wound onto a cylindrical coil form or coil form section. When the wider housing part is conical, the stated ratio can be achieved by winding the coil turns onto a conical coil body or coil body section.

In other words, in the case of a corona ignition device according to this disclosure, a coil comprising two sub-coils is connected to the center electrode. A first coil is disposed in the cylindrical main part of the housing. A second sub-coil, which preferably has larger coil turns than the first sub-coil, is disposed in the wider housing part. The two sub-coils can be designed as separate coils, which are electrically connected in series, for example by means of a plug-in connection, or these can be designed as a single coil having a coil form which extends from the cylindrical main part into the wider housing part. This coil form can be thicker in the wider housing part than in the cylindrical main part of the housing, and therefore the coil turns in the wider housing part are larger than in the main part of the housing.

BRIEF DESCRIPTION OF THE DRAWINGS

Further details and advantages of this disclosure are explained using embodiments, with reference to the attached drawings. Components that are identical and correspond to one another are labelled therein using matching reference numerals. In the drawings.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of the present invention.

Figure 1:
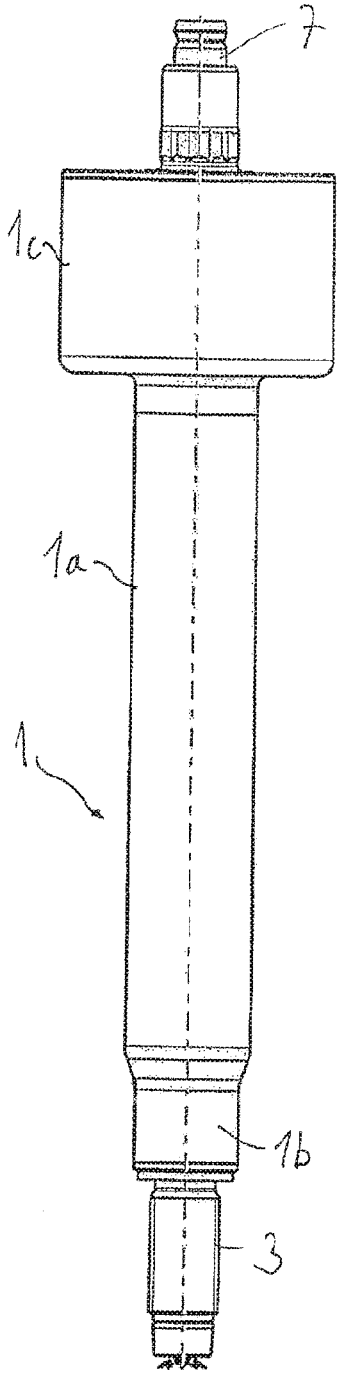
FIG. 1 shows an illustrative embodiment of a corona ignition device.
Figure 2:
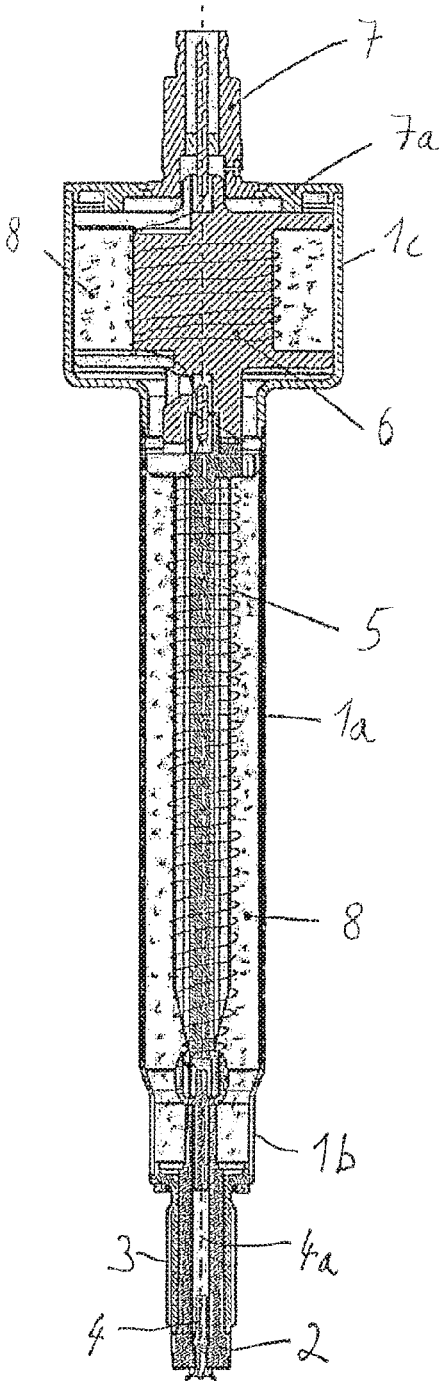
FIG. 2 shows a sectional view of FIG. 1.

The corona ignition device depicted in FIGS. 1 and 2 has a housing 1, which has a cylindrical main part 1*a*, which, on one side, adjoins a narrower housing part 1*b* and, on the other side, adjoins a wider housing part 1*c*. The adjectives "narrow" and "wide" refer to the amount of radial extension in each case. The wider housing part 1*c* therefore has a greater radius than the cylindrical main part 1*a*, which has the greatest portion of the overall length of the housing.

As shown in FIG. 2, an insulator 2 is held in the narrower housing part 1*b*. The narrower housing part 1*b* can have an external thread 3 for screwing into an engine block. A center electrode 4, which leads to one or more ignition tips, is held in the insulator 2. For sealing, a section of the center electrode 4 can comprise electrically conductive glass 4*a*, for example glass having metal or graphite particles.

A coil comprising two sub-coils 5, 6 is connected to the center electrode 4. A first sub-coil 5 is disposed in the cylindrical main part 1*a* of the housing. A second sub-coil 6 is disposed in the wider housing part 1*c*. The wider housing part 1*c* can comprise a plug-in connector 7, by means of which the corona ignition device can be connected to a voltage source. The plug-in connector 7 can comprise a cover plate 7*a*, which closes the wider housing part 1*c*. The housing interior can be filled with an electrically conductive casting compound 8. Instead of a casting compound 8, a gas insulation may be used, for example a pressurized gas insulation.

The first sub-coil 5 can taper toward the insulator 2 in order to reduce the risk of field peaks in the region of connection to the center electrode 4.

The coil turns of the second sub-coil 6 have a greater turn diameter than the coil turns of the first sub-coil 5. Apart from the tapering end section of the first sub-coil 5, all coil turns have an outer diameter that is between 0.55 and 0.57 times the inner diameter of the surrounding housing part 1*a*, 1*c*. It is particularly advantageous when the outer diameter of the coil turns is 0.56 times the surrounding inner diameter of the housing.

The number of coil turns in the wider housing part 1*c* can be, for example, between one-fourth and two-thirds the total number of turns of both sub-coils 5, 6. Particularly advantageously, between one-third and half of all coil turns are disposed in the wider housing part 1*c*.

The coil turns of the two sub-coils 5, 6 can be wound onto a single coil form, which is thicker in the wider housing part 1*c* than in the main part 1*a*. In the illustrative embodiment shown, each of the two sub-coils 5, 6 has a separate coil form. The coil form of the first sub-coil 5 can be fitted together with the coil form of the second sub-coil 6. The first sub-coil 5 is then electrically connected to the second sub-coil 6, e.g., by means of a plug-in contact. This plug-in contact can be surrounded by a shield sleeve. The shield sleeve is preferably made of metal, although this can also be a metal-coated plastic sleeve.

The coil turns of the two sub-coils 5, 6 are made of wire having a diameter of 0.3 mm to 0.6 mm, for example wire having a diameter of 0.4 mm to 0.5 mm.

Figure 3:
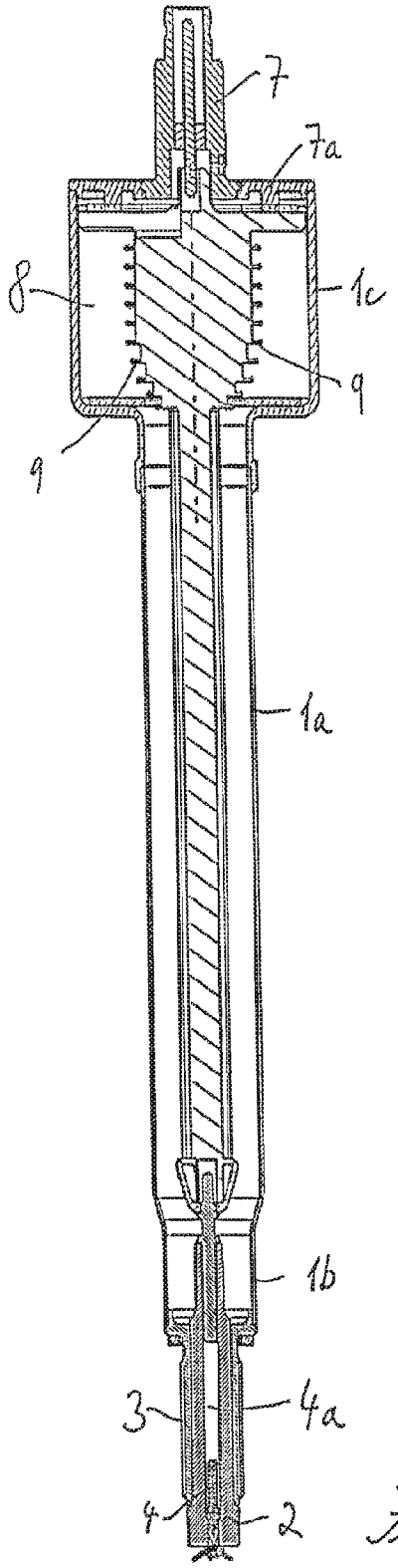
FIG. 3 shows a further illustrative embodiment of a corona ignition device.

FIG. 3 shows a corona ignition device which has only a single coil form instead of two fitted-together coil forms, wherein this single coil form extends from the cylindrical main part 1*a* of the housing 1 into the wider housing part 1*c*. The coil turns are not shown in FIG. 3, for simplicity.

The coil form widens in the wider housing part 1*c*, and therefore the coil turns in a cylindrical section of the coil form in the wider housing part 1*c* have the same ratio to the housing diameter there as in the corona ignition device of FIGS. 1 and 2.

The diameter of the coil form can change abruptly or, as shown in FIG. 3, can enlarge continuously in the wider housing part 1*c*. The coil form can widen conically or can have a rounded longitudinal cross section in a transition between the two cylindrical sections thereof.

In addition, the coil form in the wider housing part 1*c* can comprise radial projections 9 for positioning the coil turns.

While exemplary embodiments have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A corona ignition device for igniting fuel in a combustion chamber of an engine by means of a corona discharge, said corona ignition device comprising:

an insulator;

a center electrode held in the insulator;

a housing in which the insulator is held; and coil turns, which are disposed in a cylindrical main part of the housing and are connected to the center electrode;

wherein the housing widens on the side of the main part remote from the insulator to form a wider housing part, further coil turns being disposed in the wider housing part, wherein the further coil turns have a greater diameter than the coil turns in the main part and the coil turns and further coil turns are connected in series.

2. The corona ignition device according to claim 1, wherein the further coil turns are wound onto a first coil form, which is plugged onto a second coil form onto which the coil turns in the main part are wound.

3. The corona ignition device according to claim 1, wherein the number of coil turns in the wider housing part is between one-fourth and two-thirds the total number of coil turns.

4. The corona ignition device according to claim 1, wherein the coil turns in the main part and in the wider housing part are wound with wire having a diameter of 0.3 mm to 0.6 mm.

5. The corona ignition device according to claim 1, wherein most of the coil turns in the main part have an outer diameter that is between 0.55 and 0.57 times the inner diameter of the main part.

6. The corona ignition device according to claim 1, wherein in the wider housing part, the ratio between the outer diameter of the turns and the inner diameter of the wider housing part is between 0.55 and 0.57.

7. The corona ignition device according to claim 1, wherein in the main part, the diameter of the turns decreases toward the insulator.

8. The corona ignition device according to claim 1, wherein the coil turns in the main part and the coil turns in the wider housing part form two coils, which are connected by a plug-in or screw-type contact.

9. The corona ignition device according to claim 8, wherein the plug-in or screw-type contact is enclosed by a shield sleeve.

10. A corona ignition device for igniting fuel in a combustion chamber of an engine by means of a corona discharge, said corona ignition device comprising:

an insulator;

a center electrode held in the insulator; and an elongated housing in which the insulator is arranged;

said housing having a first portion in which a first coil is arranged and a second portion in which a second coil is arranged that is connected in series with the first coil;

wherein, the first portion has a larger length than the second portion, the second portion is wider than the first portion, and the second coil comprises coil turns that have a larger diameter than all coil turns of the first coil.

* * * * *